United States Patent [19]

LaRue

[11] Patent Number: 5,000,379

[45] Date of Patent: Mar. 19, 1991

[54] MAIL BOX COVER

[76] Inventor: Benjamin R. LaRue, 6719 Massachusetts Dr., Lantana, Fla. 33462

[21] Appl. No.: 540,227

[22] Filed: Jun. 19, 1990

[51] Int. Cl.[5] ..... B65D 91/00

[52] U.S. Cl. ..... 232/17; 232/38

[58] Field of Search ..... 232/17, 38

[56] References Cited

U.S. PATENT DOCUMENTS

| | | | |
|---|---|---|---|
| 4,244,512 | 1/1981 | Wise | 232/17 |
| 4,368,842 | 1/1983 | DeLange | 232/17 |
| 4,375,869 | 3/1983 | Hatch | 232/17 |
| 4,712,731 | 12/1987 | Gramelspacher | 232/17 |
| 4,813,595 | 3/1989 | Johns | 232/17 |

*Primary Examiner*—Robert W. Gibson, Jr.
*Attorney, Agent, or Firm*—Alvin S. Blum

[57] ABSTRACT

A rectangular paper or plastic film sheet has a pressure sensitive backing for sticking onto the curved top and sides of a regulation mailbox. The front face is imprinted with decorative graphics arranged to be seen from both sides. Below each graphic is imprinted an elongate address bar for receiving stick-on letters and numbers supplied in a color contrasting with the address bar for enhanced visibility. Partially cut through portions of the cover may be torn away to admit the indicating flag. The system is adapted for application without tools or special skills and enough letters and numbers are provided for identification of the mailbox as recommended by postal authorities.

8 Claims, 1 Drawing Sheet

MAIL BOX COVER

BACKGROUND OF THE INVENTION

1. Field of the Invention

This invention relates to mailboxes, and more particularly, to replaceable, stick-on overlays for U.S. Postal Service regulation mailboxes that provide both distinctive decoration and recommended identification functions.

2. Discussion of the Prior Art

Decorative mailboxes have become increasingly popular in recent years. U.S. Postal Service Regulations for residential free-standing mailboxes dictate specific shape and dimensions. To make the required mailboxes more attractive and distinctive homeowners have purchased predecorated mailboxes. Generally mailbox decorations can be provided that are painted or stenciled on, or otherwise permanently attached. Since the mailbox is exposed to the weather, the durability of the painted decoration may be a problem. Purveyors of predecorated mailboxes cannot provide great variety due to space limitations.

U.S. Pat. No. 4,712,731 issued Dec. 15, 1987 to Gramelspacher discloses a mailbox with a thin, predecorated laminated plywood cover treated with a weatherproofing material on inner and outer surfaces.

U.S. Pat. No. 4,813,595 issued Mar. 21, 1989 to Johns et al discloses a mailbox with grooved lower edges of the housing and a decorative overlay that fits over the housing and whose lower edges are held in the grooves with cooperating holes in housing and the edges of the overlay for receiving rivets to securely hold the overlay in place. The overlay material must be sturdy enough to remain in place under severe weather conditions while held by the edges.

The overlays of the prior art, being of sturdy construction and substantial dimension of 23½ inches square to cover the standard mailbox are bulky and expensive and not adaptable to the ordinary mailbox. It is therefore still a problem to provide inexpensive means to decorate the ordinary regulation mailbox with a compact device that can be carried in a large inventory of selections.

The postal authorities require that the box number or street address be applied to at least one side of the mailbox in letters at least one inch high. It is desirable to put identification, including name of occupant on both sides of the mailbox. A decorative graphic applied to both sides of the mailbox serves as further identification for small children and those with visual or mental defects who may not be able to recognize other identifying material. Many residents are reluctant to use anything that requires mechanical skills such as applying fasteners are required by the prior art. Convenient means for applying identifying names and numbers are not provided by the mailbox attachments of the prior art.

SUMMARY OF THE INVENTION

It is accordingly an object of the invention to provide a decorative cover for a regulation U.S. Postal mailbox that is easily installed without tools or special skills. It is yet another object to provide such a cover that is weatherproof, inexpensive and compact so that a wide selection of graphics may be provided in inventory without excessive space requirements and for economy of shipment and storage. It is yet another object that the invention provide convenient means for application of recommended identification on the mailbox that is easily seen from the road.

The mailbox cover of the invention comprises a large, preprinted, plastic coated sheet having a weather resistant outer surface and an inner surface coated with a pressure sensitive adhesive covered with a release sheet. The sheet is large enough to completely cover the top and sides of the regulation U.S. #1 mailbox. The material of construction is similar to that of a bumper sticker which is thin, light, weatherproof and easily applied by simply stripping off the release sheet. A partially cut through area overlying the indicating flag is torn away to permit passage of the indicating flag without need for removing and remounting the flag. The particular decorative graphics printed on the cover may be any image, design or the like that may be pleasing to the eye and may be multicolored and produced by silk screen process for example. A pair of graphics are generally arranged so that one will appear on either side of the mailbox when it is applied. Below each graphic is an elongate rectangular bar of a solid color for receiving numbers and letters of a contrasting color. A set of precut, pressure sensitive numbers and letters are included for sticking onto this rectangular bar to provide easily read identifying information.

These and other objects, advantages and features of the invention will become apparent from study of the detailed description in conjunction with the drawings.

dr

DETAILED DESCRIPTION OF THE PREFERRED EMBODIMENT

Figure 2:
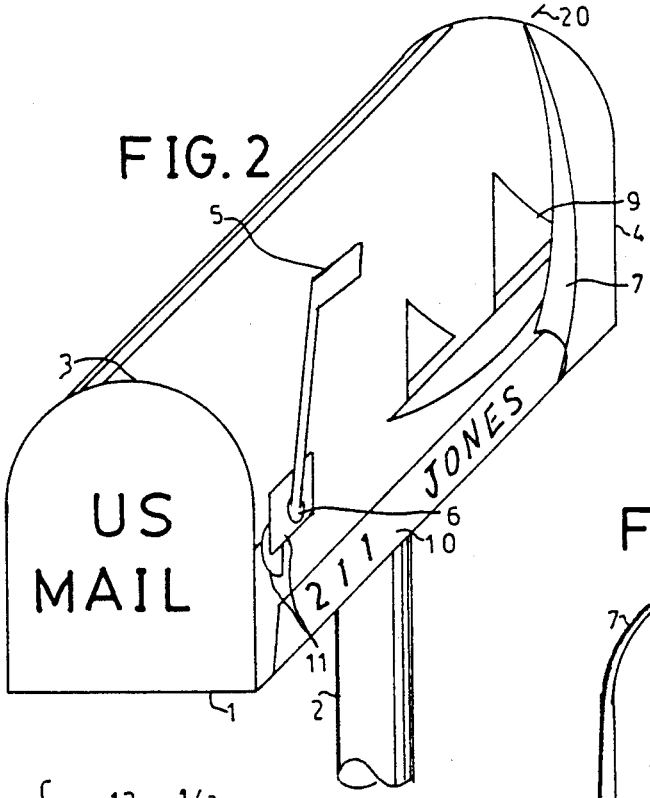
FIG. 2 is a perspective view of a mailbox with the cover of the invention partially in place.
Figure 3:
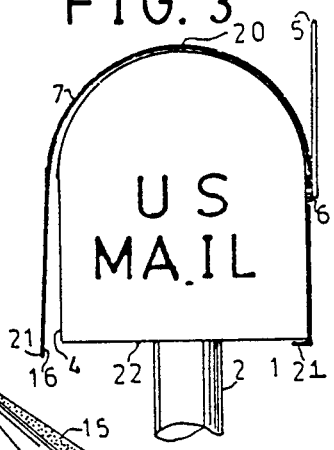
FIG. 3 is a front elevation view of a mailbox with the cover partially in place.

Referring now first to FIGS. 2 and 3, a regulation U.S. Postal Service mailbox 1 on post 2 has an inverted U shape cross section provided by a curved top 3 that extends down to straight sides 4. An indicating flag 5 pivots about an axis 6. The mailboxes are generally of a single color, undecorated and undistinctive.

A mailbox cover 7 of the invention is shown being applied to the mailbox 1. The cover 7 covers the curved top 3 and the sides 4. A pair of partially cut through portions 11 on the cover are provided. One of these is torn away to provide an aperture for passage of the flag 5. Several portions 11 are provided to accommodate different flag placements.

Figure 1:
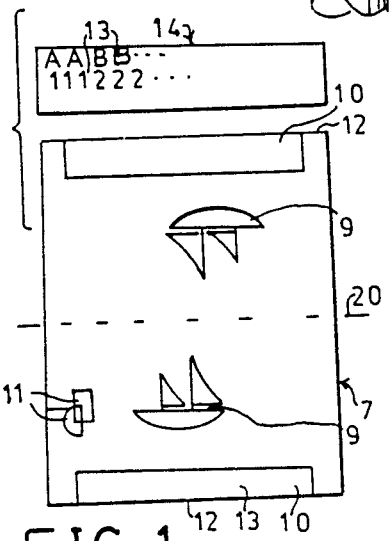
FIG. 1 is a plan view of the cover with number and letter sheet.

Referring now to FIG. 1, the cover 7 is a rectangular sheet of paper or plastic film. On the front or outer face is imprinted a pair of rectangular address bars 10, one along each of two opposite edges 12 that will become the lower edges when the cover is draped over the mailbox. These rectangular bars are black to serve as a good contrast background for the white, precut identifying numbers and letters 13 provided. These numbers and letters are at least one inch high and have a pressure sensitive adhesive backing. They are provided on a separate sheet of release paper or film 14 in sufficient quantity so that the user can compose his address and name from them and stick them onto the address bars 10.

A pair of decorative graphic elements 9 are imprinted so that they will be seen above each bar on each side of the mailbox. The imprinting may be done by means well known in the art, such as silk screening and a variety of colors and patterns may be employed. A weatherproof transparent coating protects the printing surface. The letters and numbers may have a reflection surface for enhanced night visibility.

Figure 4:
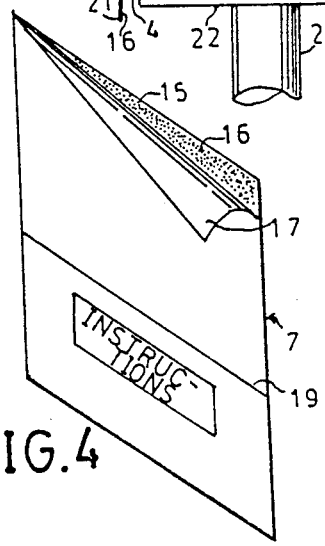
FIG. 4 is a rear view of the cover.

As best seen in FIG. 4, the rear or inside face 15 of the cover 7 has a pressure sensitive adhesive coating 16. This is protected by a peel-off release backing sheet 17. The backing sheet carries printed instructions. It is divided into two parts by a line of division 19 at a location that corresponds to the centerline 20 extending along the to of the mailbox. This makes application much easier, since the cover may be folded along this line, one half of the release paper 17 removed and the cover positioned along the centerline with the remaining release paper against the mailbox. When positioned correctly, the unprotected half of the cover is then unfolded and stuck to the mailbox. The remaining half of the release paper is then removed and the second half of the cover securely affixed against the mailbox surface.

The common length of the mailboxes is eighteen and one half inches. The preferred length of cover 7 is accordingly eighteen and one half inches. Common mailboxes are made with two different heights so that a twenty-three inch wide cover will extend from one lower edge, around the top and to the second lower edge of the larger mailbox and it would extend an inch below both lower edges of the smaller mailbox. It is preferred to provide covers in the form of a rectangle twenty-three inches wide by eighteen and one-half inches long. FIG. 3 shows how the overhanging edges 21 are tucked under and affixed to the bottom 22 of the smaller mailbox.

The rectangular address bar has a long dimension of at least ten inches and a short dimension of between one and one-half and three inches to provide a background for the letters that are at least one inch high.

The above disclosed invention has a number of particular features which should preferably be employed in combination although each is useful separately without departure form the scope of the invention. While I have shown and described the preferred embodiments of my invention, it will be understood that the invention may be embodied otherwise than as herein specifically illustrated or described, and that certain changes int he form and arrangement of parts and the specific manner of practicing the invention may be made within the underlying idea or principles of the invention within the scope of the appended claims.

I claim:

1. An identifying and decorative cover system for covering the top and sides of a U.S. Postal Service regulation mailbox, said system comprising:

(a) a rectangular paper sheet having a front face and a back face, said front face preprinted with a pair of elongate, rectangular bars of a first color arranged adjacent two opposite edges of said rectangle, and a graphic element arranged adjacent each said bar, each said graphic element arranged to be viewed with said bar below said element, said bars having a short dimension of between one and one-half and three inches and a long dimension greater than ten inches;

(b) a weatherproof transparent coating covering said front face;

(c) a pressure sensitive adhesive coating said back face for affixing to said top and sides;

(d) a first release web covering said adhesive coating, said first release web adapted for removing prior to affixing;

(e) at least one partially cut through portion of said film sheet provided for tearing away to provide an aperture for passage of an indicating flag; and (f) a plurality of precut letters and numbers of a second color, having weatherproof front faces an pressure sensitive adhesive back faces, said back faces adherent to a second release web for selective removal for application to said rectangular bars for identification purposes, said letters and numbers having a height of at least one inch, said second color being of a great contrast to said first color for enhanced visibility on said bar.

2. The system according to claim 1, in which said letters and numbers have a reflective front face for enhanced visibility.

3. The system according to claim 1, in which said rectangular paper sheet has dimensions of approximately twenty-three inches by eighteen and one-half inches.

4. The system according to claim 1, in which said first release web is cut through along a center line between said bars to facilitate handling by affixing one half of said cover at a time.

5. An identifying and decorative cover system for covering the top and sides of a U.S. Postal Service regulation mailbox, said system comprising:

(a) a rectangular film sheet having a front face and a back face, said front face preprinted with a pair of elongate, rectangular bars of a first color arranged adjacent two opposite edges of said rectangle, and a graphic element arranged adjacent each said bar, each said graphic element arranged to be viewed with said bar below said element, said bars having a short dimension of between one and one-half and three inches and a long dimension greater than ten inches;

(b) a weatherproof transparent coating covering said front face;

(c) a pressure sensitive adhesive coating said back face for affixing to said to pan sides;

(d) a first release web covering said adhesive coating, said first release web adapted for removing prior to affixing;

(e) at least one partially cut through portion of said film sheet provided for tearing away to provide an aperture for passage of an indicating flag; and (f) a plurality of precut letters and numbers of a second color, having weatherproof front faces and pressure sensitive adhesive back faces, said back faces adherent to a second release web for selective removal for application to said rectangular bars for identification purposes, said letters and numbers having a height of at least one inch, said second color being of a great contrast to said first color for enhanced visibility on said bar.

6. The system according to claim 5, in which said letters and numbers have a reflective front face for enhanced visibility.

7. The system according to claim 5, in which said rectangular film sheet has dimensions of approximately twenty-three inches by eighteen and one-half inches.

8. The system according to claim 5, in which said first release web is cut through along a center line between said bars to facilitate handling by affixing one half of said cover at a time.

* * * * *